US005865993A

United States Patent [19]

Wienicke

[11] Patent Number: 5,865,993

[45] Date of Patent: Feb. 2, 1999

[54] FILTER CENTRIFUGE WITH A DRYING DEVICE FOR THE MOIST SOLIDS COLLECTED IN THE CENTRIFUGE DRUM

[76] Inventor: Heinz-Jürgen Wienicke, Ludwig-Richter-Ring 2b, D-47447 Moers, Germany

[21] Appl. No.: 920,984

[22] Filed: Aug. 29, 1997

[30] Foreign Application Priority Data

Aug. 31, 1996 [DE] Germany ..... 196 35 346.7

[51] Int. Cl.[6] ..... F26B 5/08

[52] U.S. Cl. ..... 210/181; 210/175; 210/194; 210/360.1; 210/372; 210/376; 210/416.1; 494/13; 494/36; 494/50; 34/58; 34/376; 34/579; 34/582; 34/587; 34/591

[58] Field of Search ..... 210/175, 181, 210/194, 360.1, 369, 406, 37.2, 416, 376; 34/58, 376, 579, 582, 587, 591; 494/13, 36, 50

[56] References Cited

U.S. PATENT DOCUMENTS

| | | | |
|---|---|---|---|
| 3,724,091 | 4/1973 | Rousselet . | |
| 5,163,895 | 11/1992 | Titus . | |
| 5,426,866 | 6/1995 | Rumocki | 34/58 |

FOREIGN PATENT DOCUMENTS

| | | |
|---|---|---|
| 3141549 | 5/1983 | Germany . |
| 3340636 | 5/1985 | Germany . |
| 4417310 | 11/1995 | Germany . |

*Primary Examiner*—David A. Reifsnyder
*Attorney, Agent, or Firm*—Robert W. Becker & Associates

[57] ABSTRACT

A filter centrifuge includes a centrifuge drum having a solids removal opening for solids collected in the centrifuge drum. A solids drying housing into which the solids removal opening opens is provided. The solids drying housing has a sieve bottom, a gas inlet for introducing a drying gas, and a gas outlet for removing the drying gas.

9 Claims, 2 Drawing Sheets

FILTER CENTRIFUGE WITH A DRYING DEVICE FOR THE MOIST SOLIDS COLLECTED IN THE CENTRIFUGE DRUM

BACKGROUND OF THE INVENTION

The invention relates to filter centrifuge with a drying device for the moist solids collected within the centrifuge drum wherein the centrifuge has a solids outlet opening that opens into a solids outlet housing.

For drying the moist solids collected in the centrifuge drum different drying processes are conventionally used.

In diccontinuous filter centrifuges, e.g., as disclosed In German Patent Application 33 40 636, the filter cake in the centrifuge is freed to the greatest possible extent from the mother liquor and is optionally washed with liquid media, is then mechanically demoisterized by centrifugal forces and subsequently removed from the centrifuge drum. The moist solids thus obtained are moved into a solids outlets housing connected downstream of the centrifuge drum and are then conveyed into a thermal drying device, as disclosed in German Patent Application 31 41 549.

The disadvantages of such a process and device are as follows:

a) high apparatus expenditure due to the combination of a plurality of components (centrifuge, buffer container, transporting device, thermal dryer ), and considerable expenditure for process automation;

b) great space requirement at different heights;

c) increased risk of failure in the case of negative product properties of the solids, such as baking on the walls, conglutination etc; as well as a plurality of transfer or interface locations for process automation;

d) increased service and maintenance expenditure as well as replacement part storage;

e) increased cleaning expenditure when starting up the device.

In diccontinuous filter centrifuges, as disclosed in German Patent Application 44 17 310, having a pressure-tight encapsulated drum interior, subsequent to the mechanical demoisterization a convective solid bed drying with pressurized gas and flow of gas through the filter cake from the interior to the exterior can be performed. This process is only suitable for crystalline solids that can be easily filtered. A prerequisite is a specific high gas throughput. This system has the following disadvantages:

a) long filtration and drying times, thus reduced product capacity and uneconomical efficiency;

b) increased risk of filter cake compaction;

c) long occupation periods of the device components arranged upstream and downstream, capacity loss of the entire production facility;

d) limited economical use when the centrifuge cycle time in relation to the drying time is approximately 1:1;

e) high gas throughput results in relatively high energy costs for heating the drying gas;

f) relatively high operating cost for the recycling of the outflowing gas in a gas recirculating device;

g) high additional expenditures for compressors, heat exchangers, gas recirculating device.

In centrifuge drying devices known from U.S. Pat. No. 5,163,895 the mechanical demoisterizing step is followed by convective drying in a pressure-tight closed drum, depending on the material to be dried. After the segment-wise removal of the filter cake from the drum the interior of the drum can be used for a fluidized bed drying process which can be enhanced by applying a vacuum.

In centrifuge dryers the drum is embodied as a drying container and provides multiple options with respect to drying processes. In such drums only metallic filter media can be used. The system has the following disadvantages:

a) susceptible to imbalance problems for products that can be easily filtered and have a high density and for spontaneously filtrating solids;

b) problems in regard to non-uniform filtration and washing steps;

c) acceleration values for the centrifuging step with 600–700 G is lower than for filter centrifuges; this results in extended cycle times with reduced mechanical moisture removal; this also results in longer total cycle times and increased energy costs due to the higher initial moisture before drying and the relatively long drying times;

d) metallic filter fabrics are problematic in comparison to textile fabrics with respect to cleaning when conglutination of solids occurs ; in the case of breakdown, the accessibility of the machine with regard to inspection and cleaning is cumbersome;

e) the use of centrifuge dryers in multiproduction facilities, especially in the pharmaceutical industry, results in relatively long downtimes when a product changeover needs to be made;

f) the centrifuge dryer has no solids outlet housing and the product removal is carried out pneumatically pulsating fashion via an annular channel in the outward direction. Thus, the removal of the moist product is not possible. In the case of breakdown a very high time and labor expenditure is thus to be expected.

It is therefore an object of the present invention to provide a discontinuous filter centrifuge with which the known disadvantages of the system can be prevented whereby it is especially desired to achieve an optimal method-technological drying of the moist solids collected in the centrifuge drum and still with minimal mechanical expenditure and minimal space requirement without adversely affecting the centrifuge capacity.

SUMMARY OF THE INVENTION

The inventive filter centrifuge is primarily characterized by:

a centrifuge drum having a solids removal opening for solids collected in the centrifuge drum;

a solids drying housing into which the solids removal opening opens;

the solids drying housing having a sieve bottom, a gas inlet for introducing a drying gas, and a gas outlet for removing the drying gas.

Advantageously, the sieve bottom is a porous filter plate, preferably a frit.

The solids drying housing comprises a pressure chamber arranged under the sieve bottom and the gas inlet opens into the pressure chamber.

The solids drying housing has a bottom opening below the pressure chamber and the sieve bottom, wherein the sieve bottom and the pressure chamber are embodied as a pivotable flap or a slide allowing removal of the solids from the solids drying housing through the bottom opening.

Advantageously, the gas outlet comprises a gas filter.

The filter centrifuge may further comprise a drying gas recycling device connected to the gas outlet. The device then preferably further comprises return lines for returning the drying gas, exiting from the drying gas recycling device, to the gas inlet.

According to the present invention, the solids outlet housing is embodied as a solids drying housing and comprises a sieve bottom that is permeable for the drying gas and comprises also a gas outlet. Thus, after centrifugation the filter cake, which, in general, is in the form of solids that are moist, is directly introduced into the drying device (solids drying housing ) into which the drying gas is introduced through the sieve bottom so that the solids heap is exposed to the drying gas flowing therethrough for removing moisture. The moist drying gas is removed preferably via a heated gas filter and is returned via a recirculating recycling device to the drying gas inlet. At the end of the drying process the solids heap is fluidized. After completion of drying the sieve bottom which is embodied as a pivotable flap or slide is opened so that the dried solids fall downwardly or are pneumatically conveyed with an additional conveying device.

This has the following principal advantages:

a) compact system, all method steps from the processing of the suspension to the dried end product can be realized within one device;

b) all discontinuous filter centrifuges can be correspondingly retrofitted;

c) optimal capacity use by performing separately and parallel of the method steps of centrifugation and drying;

d) in regard to process control, the system requires only one control unit;

e) greater application range because the filter cake removal can be performed in the moist state of the solids as well as in a pre-dried state, respectively, in the finally dried state;

f) the device, in general, is not subject to pressurized container regulations;

g) reduced operating costs due to the more effective pre-moisture removal of moisture by increased centrifugal forces, reduced amount of drying energy;

h) higher operative safety; no imbalance problems; due the use of textile filter fabrics, reduced danger of conglutination or plugging.

BRIEF DESCRIPTION OF THE DRAWINGS

The object and advantages of the present invention will appear more clearly from the following specification in conjunction with the accompanying drawings, in which.

DESCRIPTION OF PREFERRED EMBODIMENTS

The present will now be described in detail with the aid of several specific embodiments utilizing FIGS. 1 and 2.

Figure 1:
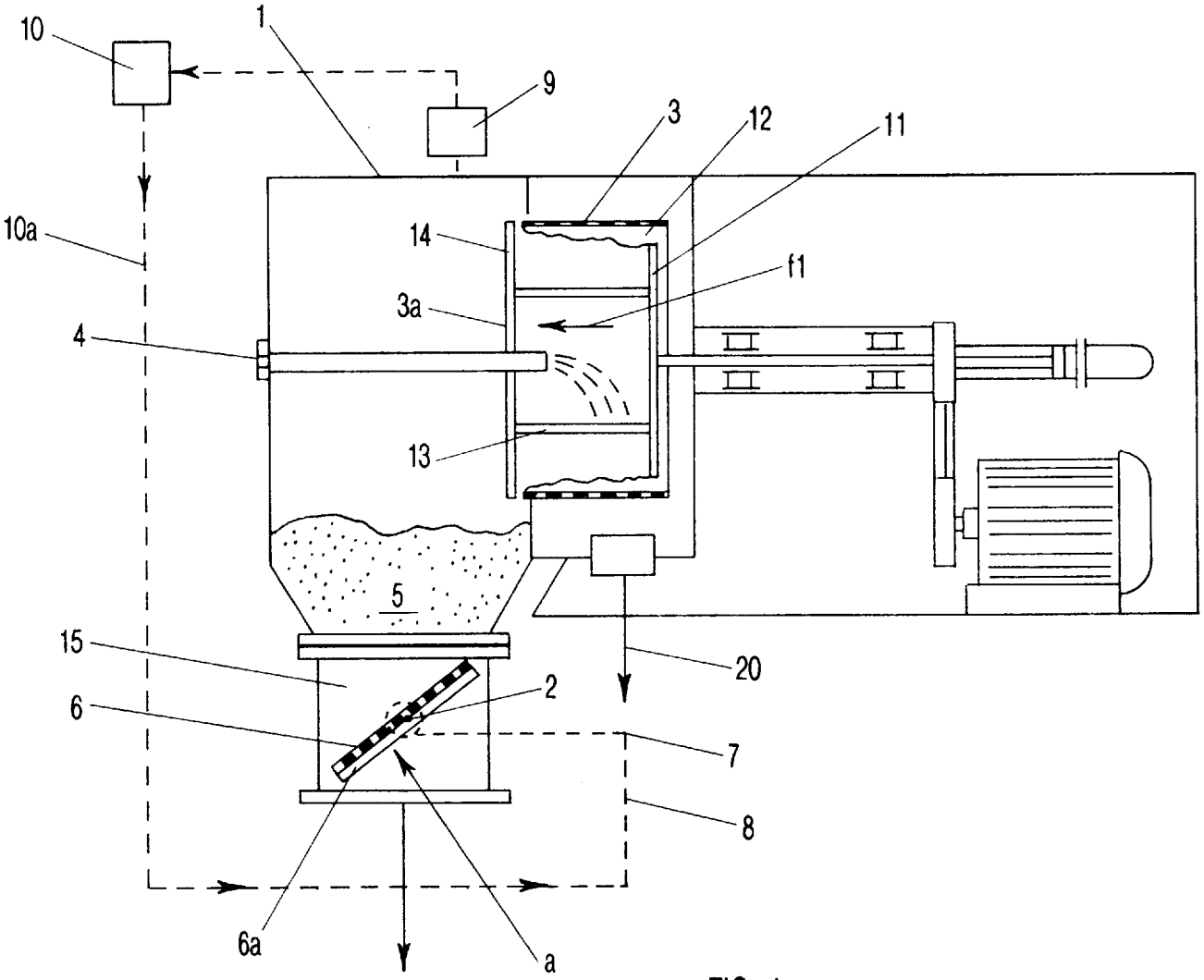
FIG. 1 shows a schematic cross-sectional view of a first embodiment of the invention in connection with a slip filter centrifuge.
Figure 2:
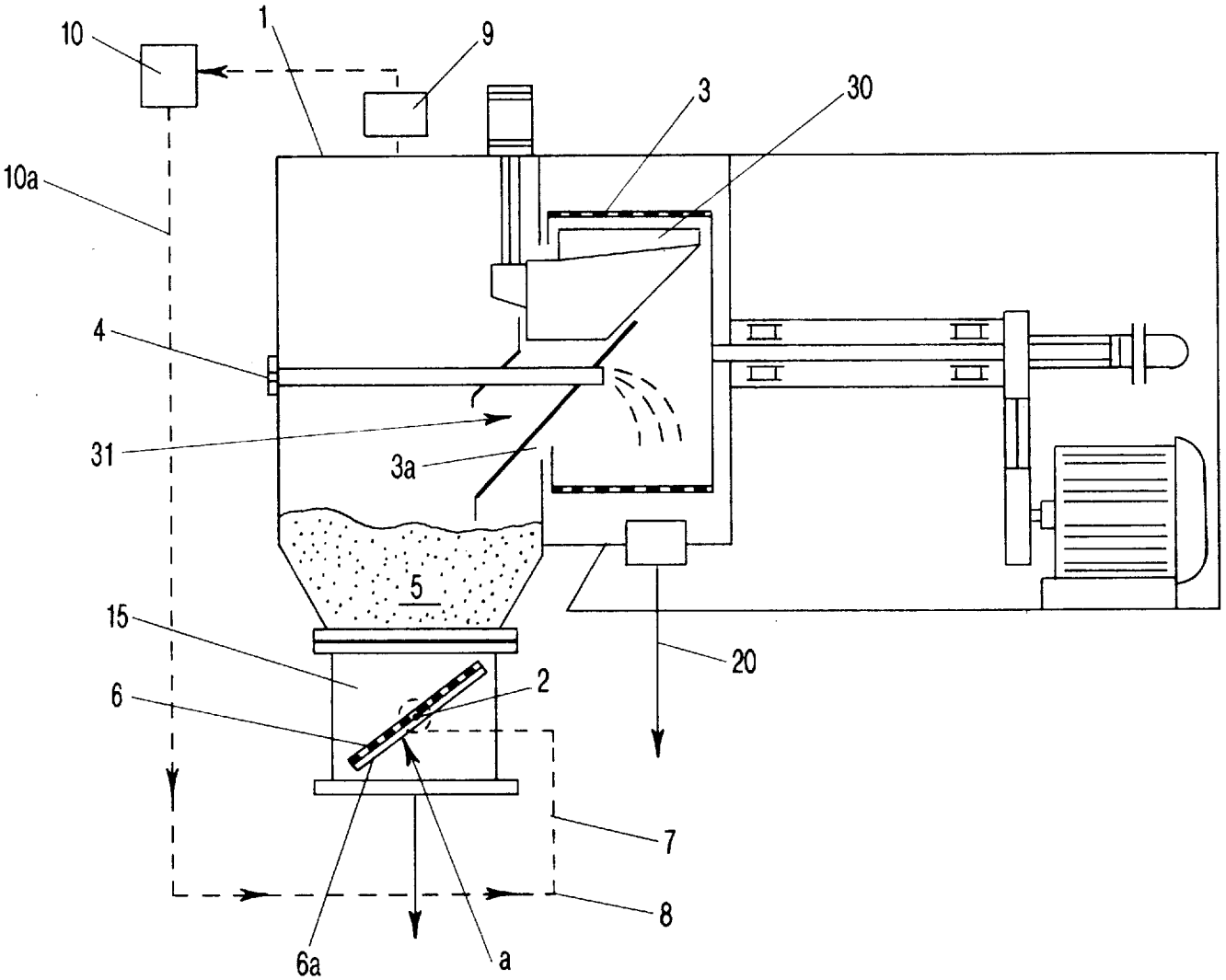
FIG. 2 shows a schematic view of a second embodiment in connection with a scraper blade centrifuge.

FIGS. 1 and 2 show the centrifuge only schematically by representing the sieve drum 3 which is rotated about its horizontal axis. The suspension to be centrifuged supplied through the inlet tube 4. The filtrate is removed via the filtrate outlet 20 extending from the housing in which the centrifuge drum 3 is mounted, and the moist solids are removed through and opening 3*a* at the centrifuge drum 3 and introduced into the solids outlet housing 1 arranged downstream which is inventionally embodied as drying housing.

According to FIG. 1 a pusher bottom 11 is positioned within the interior of the centrifuge drum 3 and can be displaced in the direction of the drum axis. The textile filter fabric 12 is fastened to the pusher bottom 11, on the one hand, and to the edge or rim of the centrifuge drum 3 surrounding the solids removal opening 3*a*, as is conventional in slip filter centrifuges. A centrifuge lid 14 is connected to the pusher bottom 11 for closing off the end face of the centrifuge drum 3 respectively, the removal opening 3*a*, by spacer bolts 13.

To the bottom of the solids outlet or drying housing 1, flange 15 is connected in which a bottom flap a pivotable about the axis 2 is supported. In the closed position it extends horizontally. This bottom plate a is provided at its upper side with a gas-permeable sieve bottom 6, especially in the form of a porous filter plate, especially a frit. Below this sieve bottom 6 a pressure chamber 6*a* is arranged into which the drying gas inlet 7 opens.

The pivotable bottom flap can be substituted by a slide comprising a sieve bottom and a pressure chamber.

After completion of this centrifuging step, the moist solids in the centrifuge drum are displaced by moving the pusher bottom 11 in the direction of arrow f1 from the sieve drum 3 into the solids outlet housing 1 in which they form a solids heap on the sieve bottom 6. The lower portion of the solids outlet housing 1 must have a greater receiving volume for the filter cake then the nominal maximum filling volume of the drum 3 so that the filter cake heap 5 is substantially below the lowermost point of the drum rotation area. The surface area of the sieve bottom 6 is matched to the amount of moist solids 5 to be dried.

For the drying step, hot drying gas is introduced via the drying gas inlet 7, preferably at a pressure of 150–200 meter of water (15–20atm) into the pressure chamber 6*a* below the sieve bottom 6 and thus flows through the filter cake heap 5. The drying gas which becomes saturated with moisture is removed via the heated gas filter 9 and introduced into the drying gas recycling device 10 from where it is returned via return lines 10*a* to the drying gas inlet system (7). For material that is difficult to demoisterize, a connecter 8 is provided for supplying vacuum to the device. For vacuum operation, the solids outlet housing must be embodied as a pressure-tight container. This method step is applicable only for pressure-tight sieve drums. After completion of drying the pivot flap or the slide embodiment of the sieve bottom (inclusive the pressure chamber ) is opened and the dried solids fall downwardly or can be further conveyed pneumatically by an auxiliary device.

According to FIG. 2, the removal of the moist solids from the centrifuge drum is carried out with a scraper blade device 30 and a correspondent chute 31.

The inventive drying system can also be arranged downstream of conventional centrifuge dryers.

The present invention is, of course, in no way restricted to the specific disclosure of the specification and drawings, but also encompasses any modifications within the scope of the appended claims.

What I claim is:

1. A filter centrifuge comprising:

a centrifuge drum having a solids removal opening for solids collected in said centrifuge drum;

a solids drying housing into which said solids removal opening opens;

said solids drying housing having a sieve bottom, a gas inlet for directly or indirectly introducing a drying gas into said sieve bottom, and a gas outlet for removing the drying gas.

2. A filter centrifuge according to claim 1, wherein said sieve bottom is a porous filter plate.

3. A filter centrifuge according to claim 2, wherein said filter plate is a frit.

4. A filter centrifuge according to claim 1, wherein said solids drying housing comprises a pressure chamber arranged under said sieve bottom, and wherein said gas inlet opens into said pressure chamber.

5. A filter centrifuge according to claim 4, wherein said solids drying housing has a bottom opening below said pressure chamber and said sieve bottom, and wherein said sieve bottom and said pressure chamber are embodied as a pivotable flap allowing removal of the solids from said solids drying housing through said bottom opening.

6. A filter centrifuge according to claim 4, wherein said solids drying housing has a bottom opening below said pressure chamber and said sieve bottom, and wherein said sieve bottom and said pressure chamber are embodied as a slide allowing removal of the solids from said solids drying housing through said bottom opening.

7. A filter centrifuge according to claim 1, wherein said gas outlet comprises a gas filter.

8. A filter centrifuge according to claim 1, further comprising a drying gas recycling device connected to said gas outlet for recycling the drying gas containing moisture after passing through said solids drying housing.

9. A filter centrifuge according to claim 8, further comprising return lines for returning a recycled drying gas, exiting though an outlet of said drying gas recycling device, to said gas inlet.

* * * * *